US005094181A

United States Patent [19]

Fuerst

[11] Patent Number: 5,094,181

[45] Date of Patent: Mar. 10, 1992

[54] EMERGENCY FLOAT SYSTEM FOR WATER CRAFT

[76] Inventor: Erwin J. Fuerst, 4900 Ocean Blvd., #504, Sarasota, Fla. 34242

[21] Appl. No.: 587,394

[22] Filed: Sep. 25, 1990

[51] Int. Cl.[5] ..... B63C 7/00

[52] U.S. Cl. ..... 114/54

[58] Field of Search ..... 114/44, 45, 49, 53, 114/54, 183 R, 183 A

[56] References Cited

U.S. PATENT DOCUMENTS 1,293,899 2/1919 Pendergast ..... 114/54

4,075,965 2/1978 Lasch ..... 114/183 R

FOREIGN PATENT DOCUMENTS 135321 11/1919 United Kingdom ..... 114/49

*Primary Examiner*—Jesus D. Sotelo

*Attorney, Agent, or Firm*—Barnes, Kisselle, Raisch, Choate, Whittemore & Hulbert

[57] ABSTRACT

An emergency buoyancy system for small water craft without built-in flotation which includes an elongate, inflatable container of sausage-like shape having a support harness at each end. Flexible battens distributed crosswise of the container provide stabilization and an optional abrasion resistant envelope can protect the containers against abrasion or puncturing. The devices are to be suspended below the hull of a vessel and inflated to provide additional buoyancy to aid in the flotation of the craft.

2 Claims, 1 Drawing Sheet

EMERGENCY FLOAT SYSTEM FOR WATER CRAFT

FIELD OF INVENTION

The invention relates to a system and apparatus for maintaining boats afloat after hull damage or other causes which result in water in the hull.

BACKGROUND AND OBJECTS OF THE INVENTION

Many pleasure craft are subject to sinking if the hull is breached to allow water to enter. Some small boats, such as canoes, folding boats or dinghys can be made non-sinkable by the installation of sufficient buoyant chambers or buoyant foam to keep the boat afloat though filled with water or capsized.

However, moderate size boats used in offshore cruising, either sail boats or power boats, do not have sufficient inboard space for the quantity of buoyancy material required to keep them afloat.

One system for emergency use lies in collapsible chambers which overlie the sole (floor) and side bunks of a cabin cruiser and serve essentially as carpet or pads until inflated to fill the cabin and provide emergency buoyancy. This system is objectionable in that it inhibits access to underbunk storage and to the bilge chambers. It has the advantage of in situ utilization but is subject to accidental inflation which can endanger occupants.

The present invention is intended to provide an emergency float system for cabin cruisers, sail boats and other pleasure craft of moderate size without built-in flotation. It is also an object to provide a system and apparatus which is useful to allow salvage of a damaged boat but also to provide sufficient lift to escape grounding. The versatility of the system offers such uses as:

(1) Escape from simple grounding common in shallow cruising grounds exemplified by that in the Bahamas, Chesapeake Bay, tidal zones, intercoastal waterways, the Gulf Coast and Florida;

(2) Groundings complicated by major hull breaches where freeing the craft would result in sinking;

(3) Major hull breaches in open sea due to the striking of a submerged log, whale or other obstruction or after demasting, etc.;

Thus, it is an object of the present invention to provide a simple and relatively inexpensive system and apparatus which can be readily stored in available space on board, and which can be quickly installed in the location appropriate to the particular emergency.

A further object of the invention lies in spaced reinforcing and protective battens on the inflatable containers and an envelope of scuff resistant material to minimize abrasion on the containers. A still further object is the provision of a pressure control valve available at deck level for deflation in the event of undue expansion of contained gas or for intentional deflation. Another object lies in the deployment of the device with proper guide lines and weight location to assist in proper positioning.

Other objects and features will be apparent in the following description and claims in which the invention is described and details provided to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
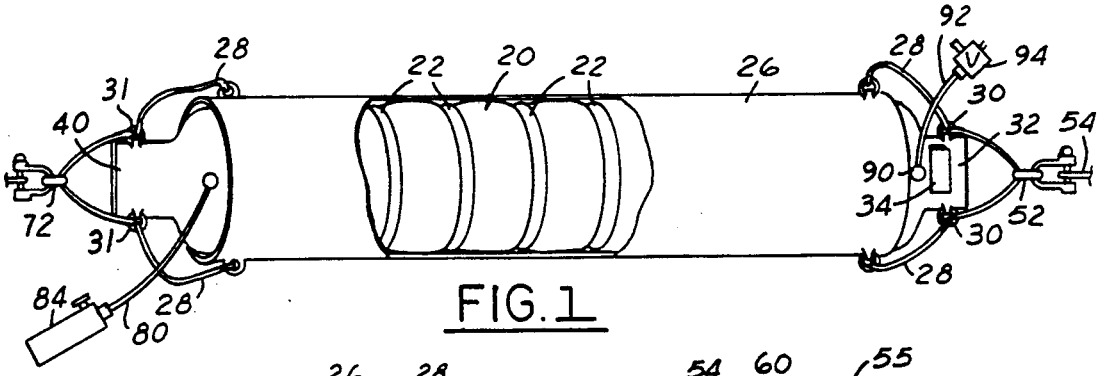
FIG. 1, a plan view of the gas container inflated but not deployed.
Figure 3:
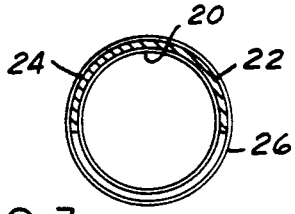
FIG. 3, a section of the inflated container.

In FIGS. 1 and 3, the container 20 is illustrated consisting of gas impervious tube, as, for example, not deployed, but shown in inflated condition. Semi-circular pockets 22 overlying the tube contains flexible fiberglass elongate battens 24 shown in section in FIG. 3 to position on the bottom of the tube when deployed. For an average size pleasure boat, about seven spaced pockets and battens would suffice. As protection for the inflatable tube, a sleeve 26 of scuff resistant material may be used to envelop the tube. However, a water-air tight, abrasion resistant Neoprene TM is available and with this material the scuff resistant envelope can be optional. The scuff resistant material can be material of life-raft quality which will avoid puncturing of the Neoprene tube by edges of a breach in the hull or barnacles. This sleeve 26 or the container 20 has two lines 28 attached at each end to fasten it to loops 30 and 31 at the opposite ends of the main tube container 20.

Figure 2:
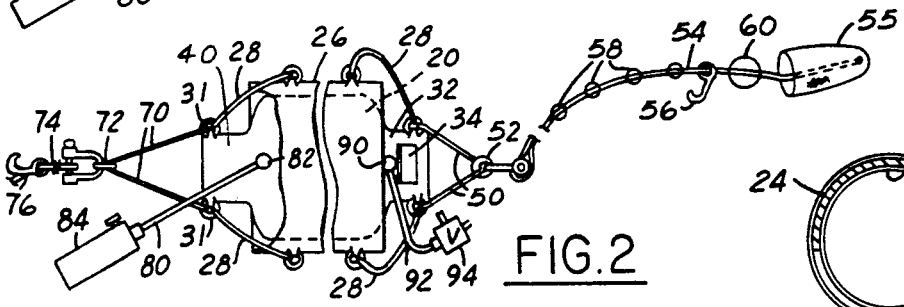
FIG. 2, a broken view of the container showing weight location on guide lines.

Referring now to FIGS. 1 and 2, the main Neoprene cylinder 20 has a flat, relatively-wide, end tape 32 secured to one end of the Neoprene tube preferably formed of doubled and folded material for extra strength. Enclosed within this tape or otherwise secured is a flat lead weight 34 weighing three to five pounds. On opposite side of this tape 32 are fastening loops or rings 30 above referenced. At the other end of the tube is also a flat end tape 40 secured to the Neoprene tube 20 and having fastening loop or rings 31 at each side. All the lines are preferably made of Nylontm TM webbing which is easier to handle than rope and is less likely to knot up or become entangled.

At the right hand end of the structure, as viewed in FIGS. 1 and 2, are lines 50 attached to a common ring 52. Detachably secured to this ring 52 is a guide line 54,the distal end of which is securely fastened to the bottom of a canvas container 55. Between the ring 52 and container 55 are a plurality of spaced lead weights 58 weighing about 6 ounces each. The guide line 54 is preferably long enough that lines can be secured to the craft at stanchions or cleats before launching the deflated tube. The length of the guide line for use at the stern is preferably about three times the distance between the point of fixation and the mid-stern of the craft. The middle one-third of the guide line 54 has the weights 58. For use at the bow, the guide line length can be shorter, for example, about two times the distance between the point of fixation to the mid-bow with similar weights covering the central section. To insure correct placement of guide lines before launching the tube overboard, a marker 60 can be placed on the guide line to indicate the distance between a port side point of attachment and the starboard side point of attachment. The bag container 55 will have the line 54 furled within it for storage and the line will unfurl easily as one walks the line around the stern or the bow. An adjustable hook 56 can be applied to the line 54 to attach the line to a stanchion and become the point of fixation.

At the other end of the tube 20 (left in FIGS. 1 and 2) are lines 70 connecting rings 31 to a common ring 72 to which is connected a detachable fixation line 74 with a hook 76 which may be adjustably placed to the desirable length on the line 74.

The guide line 54 can be disconnected at ring 52 and also the line 74 can be disconnected at ring 72. If there are crew members available, two people can submerge the guide line 54 and work it over the rudder and propeller and then walk forward simultaneously, one on the port side, and one on the starboard side, to a point of fixation on a stanchion. The guide line is then reattached to ring 52 on the container 20. The buoyancy container is then affixed at one end on one side of the craft and lowered into the water and pulled around under the hull and inflated. This method of deployment can be used to advantage when a power boat with a relatively flat keel and flat bottom is grounded. The guide line 54, for example, can be submerged around the stern and brought forward to the point of impact and the buoyancy cylinder strategically placed where most needed.

The Neoprene float tube 20 is to be inflated after deployment under the hull of the water craft, by a source of gas under pressure such as a tank of $CO_2$ gas. In FIGS. 1 and 2 is shown a gas conduit 80 connected and sealed to port 82 on one end of the tube 20. A tank 84 is connected to conduit 80 having a valve with a rip cord for the introduction of gas to the float tube. At the other end of the float tube is also tube port 90 with a conduit connection 92. This conduit has a pressure relief valve 94 which can be set for an automatic blow-off pressure. The valve can also be manually actuated to relieve pressure. The hose conduits are long enough to reach up to the boat deck for proper manipulation. Both valves can be opened to release gas when the float tube is to be deflated after use.

Figure 4:
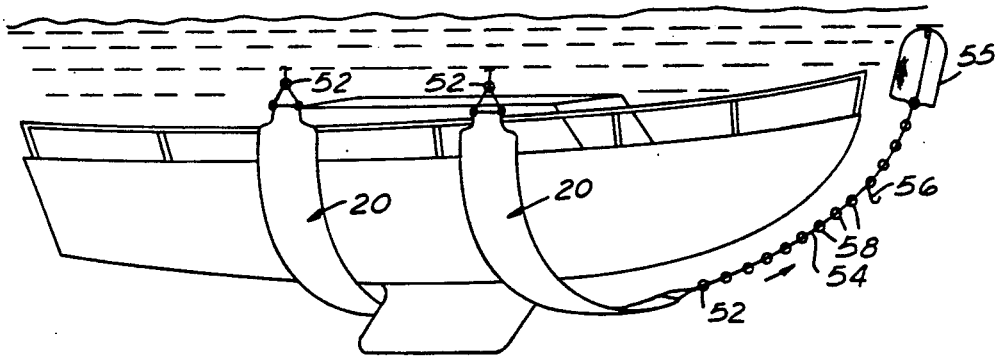
FIG. 4, a schematic broad side view of a water craft and relative positioning of the uninflated container.

In FIG. 4, a boat is illustrated with the flotation tubes in place but not yet inflated.

Figure 5:
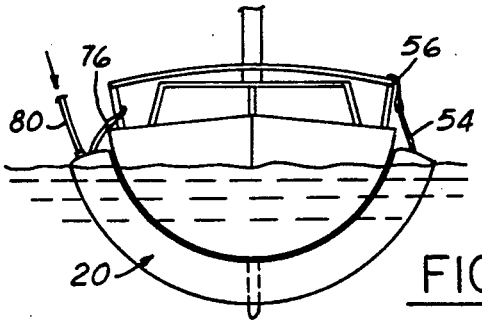
FIG. 5, an end view of a water craft with inflated container in place.

In FIG. 5, an inflated flotation tube is shown in deployed position.

In the use of the device, it must be appreciated that a simple sausage-shaped device cannot easily be deployed. Pulling such a device under the hull results in twisting and turning and leads to difficulties in inflation. In the present invention, the guide lines at each end can be secured before the uniflated tube is lowered into the water. The lead plate 34 assists in stabilizing the unit as it is lowered. Also, the pocketed battens 24 prevent twisting of the tube and stabilize the tube by the effect of gravity to keep the battens on the bottom of the tube. The adjustable hooks 56 and 76 can be attached at the point of fixation, on a stanchion, for example, after the guide line 54 has hauled the cylinder around the bottom and properly snugged it against the bottom of the hull. The deployment may also be accomplished in deep water by securing one end to a cleat or stanchion at one side of the boat and dropping the weighted end 32 with lead 34 straight down while holding the line 54. Hauling in the line 54 from the other side of the boat will bring the tube under the hull. The battens again bring the tube in place with the battens on the lower side. The battens flex to conform to the curvature of the tube when inflated.

Once the tube 20 is deployed at one end (fore) or at the other end (aft), the valve in the $CO_2$ tank 84 can be opened and the tube inflated to provide the required flotation effect.

As to the required size of the flotation tubes, if a given boat has an estimated negative buoyancy of, for example, 40%, this would have to be compensated by a suitable buoyancy tube plus a safety margin of 10 to 15%. For example, if displacement is 10,000 pounds, negative buoyancy would be 4000 pounds. This equals 62.5 cubic feet to be displaced plus 15% safety margin of 9.3 cubic feet. Using two buoyancy tubes, one would have to have an underwater capacity of 36 cubic feet. A tube 2 feet in diameter and 12 feet long would provide the 37 plus cubic feet needed in this circumstance.

Figure 6:
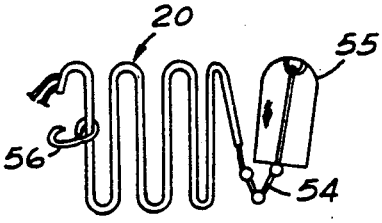
FIG. 6, a schematic view of a folded container.

In FIG. 6, the deflated tube is shown in accordion folds for storage purposes so it can be stored in a hold or under a seat bench.

What is claimed is:

1. An emergency buoyancy apparatus for use in buoying up disabled small craft which comprises:

(a) an elongate gas impervious tube having a length to embrace transversely the bottom of a small craft hull from starboard waterline to port waterline and adapted to be inflated by a source of compressed gas, (b) a flat end piece secured to each end of said tube for securing handling lines at each end, (c) flat weight in one of said end pieces to facilitate control of the apparatus during deployment, (d) an inflation tube connected to one end of said tube to introduce gas from a compressed gas source to said tube to inflate the tube, (e) a first fixation handling line secured to one flat end piece of said tube, and (f) a second handling line secured to the other flat end piece having a series of weights spaced along the length of said second handling line to stabilize the line as it is maneuvered to secure the tube in place under the hull.

2. An emergency buoyancy apparatus for use in buoying up disable small craft which comprises:

(a) an elongated gas impervious tube having a length to embrace transversely the bottom of a small craft hull from starboard waterline to port waterline and adapted to be inflated by a source of compressed gas, (b) a series of longitudinally spaced flexible battens disposed laterally on one side of said tube overlying substantially 180° of said tube and secured to said tube to stabilize the tube during deployment and prevent twisting of said tube, (c) flat end pieces secured to each end of said tube for securing handling lines at each end, one of said end pieces having a flat weight secured thereto, (d) a first fixation handling line secured to one flat end piece of said tube, and (e) a second handling line secured to the other flat end piece having a series of weights spaced along the length of said second handling line to stabilize the line as it is maneuvered to secure the tube in place under the hull.

* * * * *